US006066812A

United States Patent [19]

Lee

[11] Patent Number: 6,066,812

[45] Date of Patent: May 23, 2000

[54] LAYERED STRUCTURE FOR KEYSWITCH

[75] Inventor: Muchuan Lee, Taipei, Taiwan

[73] Assignee: Silitek Corporation, Taipei, Taiwan

[21] Appl. No.: 09/283,204

[22] Filed: Apr. 1, 1999

[51] Int. Cl.[7] ..... H01H 13/70

[52] U.S. Cl. ..... 200/5 A; 200/515; 200/306

[58] Field of Search ..... 200/5 A, 8 CR, 200/512–517, 306

[56] References Cited

U.S. PATENT DOCUMENTS 4,701,579 10/1987 Kurachi et al. ..... 200/5 A 5,218,177 6/1993 Coleman, III et al. ..... 200/5 A

*Primary Examiner*—J. R. Scott

*Attorney, Agent, or Firm*—Rosenberg, Klein & Lee

[57] ABSTRACT

A layered structure for a keyswitch includes a lower flex circuit layer, an upper flex circuit layer and a spacer layer therebetween. A plurality of projecting flanges are arranged radially and extending from through holes formed in the spacer layer. The flanges may be placed on the lower surface of the upper layer, the upper surface of the lower layer or on the spacer. The flanges separate the spacer and the flex circuit layer such that air passages are formed between each two adjacent flanges, so that a vacuum sucking effect is substantially prevented.

18 Claims, 6 Drawing Sheets

PIROR ART

PIROR ART

PIROR ART

PIROR ART

LAYERED STRUCTURE FOR KEYSWITCH

FIELD OF THE INVENTION

The present invention relates to a layered structure of keyswitch, wherein a plurality of layers with printed circuit are arranged on the bottom side of the keyswitch to enhance the smoothness of key pressing operation and prevent unstable transmission of signal.

BACKGROUND OF THE INVENTION

The layered structures with flexible circuit film are generally used in the actuation structure of keyswitch. The conventional keyswitch comprises layered structure including a lower flex circuit board, an upper flex circuit board and a spacer layer. The lower flex circuit board has a plurality of electric contacts on the upper surface thereof. The upper flex circuit board is arranged upon the lower flex circuit board and has a plurality of electric contacts on the bottom side thereof and corresponding to the contacts of the lower layer. The spacer layer is sandwiched between the upper and the lower layers and has a plurality of through holes corresponding to those contacts. When the key cap is pressed, the rubber dome below the key cap is collapsed such that the contacts on the upper and the lower layers are electrically connected. When the key cap is released, the contacts on the upper and lower layers are separated due to the elastically restoring force of the rubber dome.

However, the upper and lower circuit layer, and the spacer layer in the conventional switch are tightly attached together, a closed space is easily formed within each through hole. A nearly vacuum state is established in the through hole when the key cap is pressed and air is repelled from the through hole. The upper layer is hard to separate from the lower layer quickly and the electrical connection state is remained due to the sucking force of the nearly vacuum state. Therefore, letter or command input by the keyswitch will be probably repeated.

Therefore, there is an endeavor in preventing the sucking effect. As shown in FIGS. 1A and 1B, at least one first spacer block 11 is arranged around the contact 10 of the upper layer circuit 1, and at least one second spacer block 21 is arranged around the contact 20 of the lower layer 2 and corresponding to the first block 11. The distance between the two blocks 11 and 21 is smaller than the distance between the two contacts 10 and 20 such that the two blocks will be in contact before the connection of the two contact when key is pressed. Therefore, an air leaking passage is provided. However, in above configuration, both the first block 11 and the second block 21 are formed within the round hole 30 on the spacer 3. In other word, the upper layer 1, lower layer 2 and the spacer 3 outside the hole 30 are still tightly closed even after the key cap is released. The air passages 31 provided by the blocks 11 and 21 do not function well because they are placed within the closed space 30. The vacuum sucking effect still remains.

FIGS. 2A and 2B show another conventional keyswitch wherein the first block 11 around the contact 10 of the upper layer 1 and the second block 21 around the contact 20 of the lower 2 are in contact before the key be pressed. Moreover, the two contacts are separated by a specific distance before key pressing and in contact after key pressing, thus provides air outlet. However, the blocks 11 and 21 are of ring-shaped configuration around the corresponding contacts and have long distance to the contacts such that the upper layer 1 may fall on the lower layer 2 due to the weight themselves. A closed ring is formed around the first block 11 and the second block. Therefore, the vacuum sucking effect still remains.

It is an object of the present invention to provide a layered structure for keyswitch wherein a plurality of projecting flanges are arranged radially outside the through holes of the spacer layer, and placed on the lower surface of the upper layer, the upper surface of the lower layer or the spacer. The flanges separate the spacer and the flex circuit layer such that air leaking passage is formed between two adjacent flanges and the vacuum sucking effect is substantially prevented.

It is another object of the present invention to provide a layered structure for keyswitch wherein a plurality of projecting flanges are provided radially on the upper or lower surface of the spacer layer, the lower surface of the upper layer or the upper surface of the lower layer, and arranged in a broad region and with uniform separation. The layer can sustain more pressure and the air can flow uniformly and smoothly within the keyswitch.

The various objects and advantages of the present invention will be more readily understood from the following detailed description when read in conjunction with the appended drawing, in which:

DETAIL DESCRIPTION OF PREFERRED EMBODIMENT

Figure 1A:
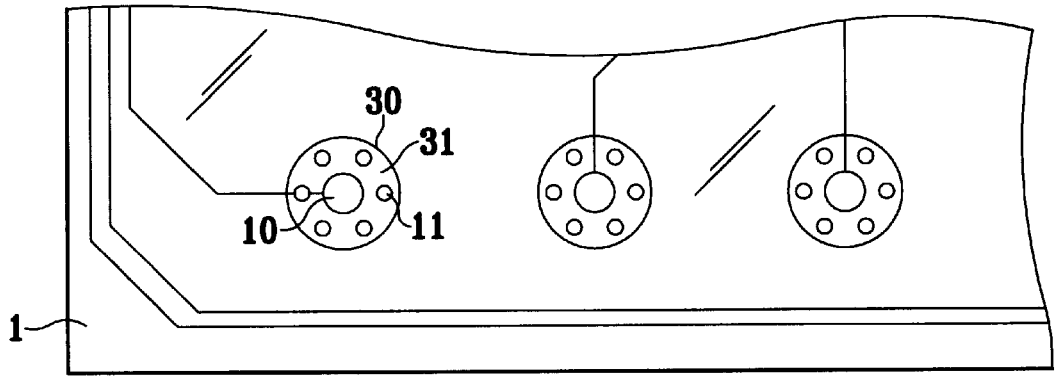
FIG. 1A is the partially top view of a conventional layered structure of keyswitch.
Figure 1B:
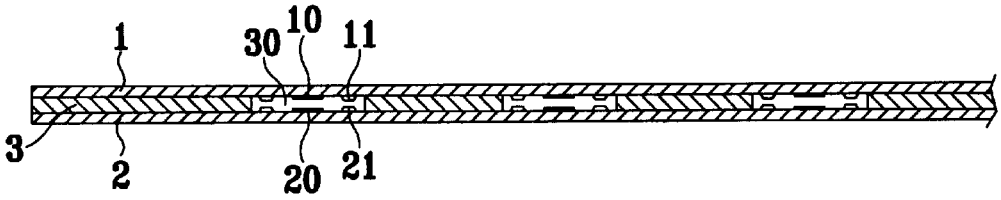
FIG. 1B is the side view corresponding to that shown in FIG. 1A.
Figure 2A:
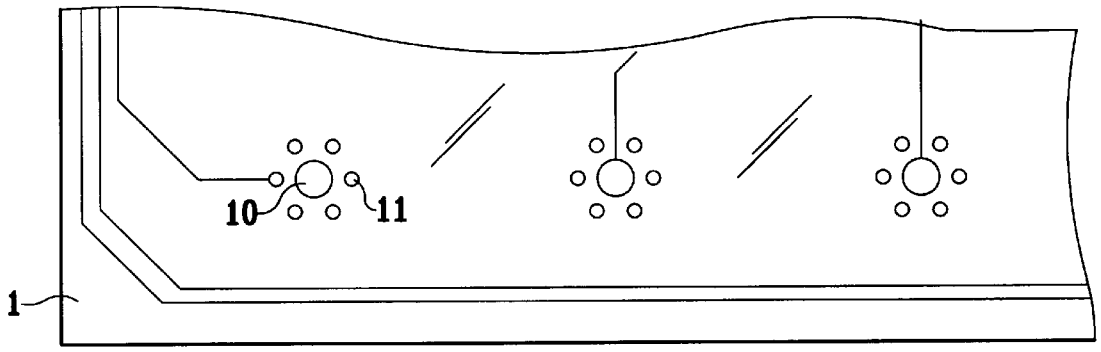
FIG. 2A is the partially top view of another conventional layered structure of keyswitch.
Figure 2B:
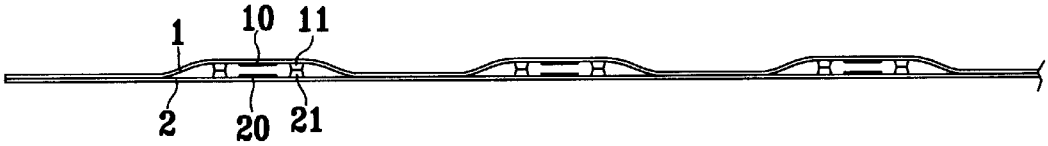
FIG. 2B is the side view corresponding to that shown in FIG. 2A.
Figure 3:
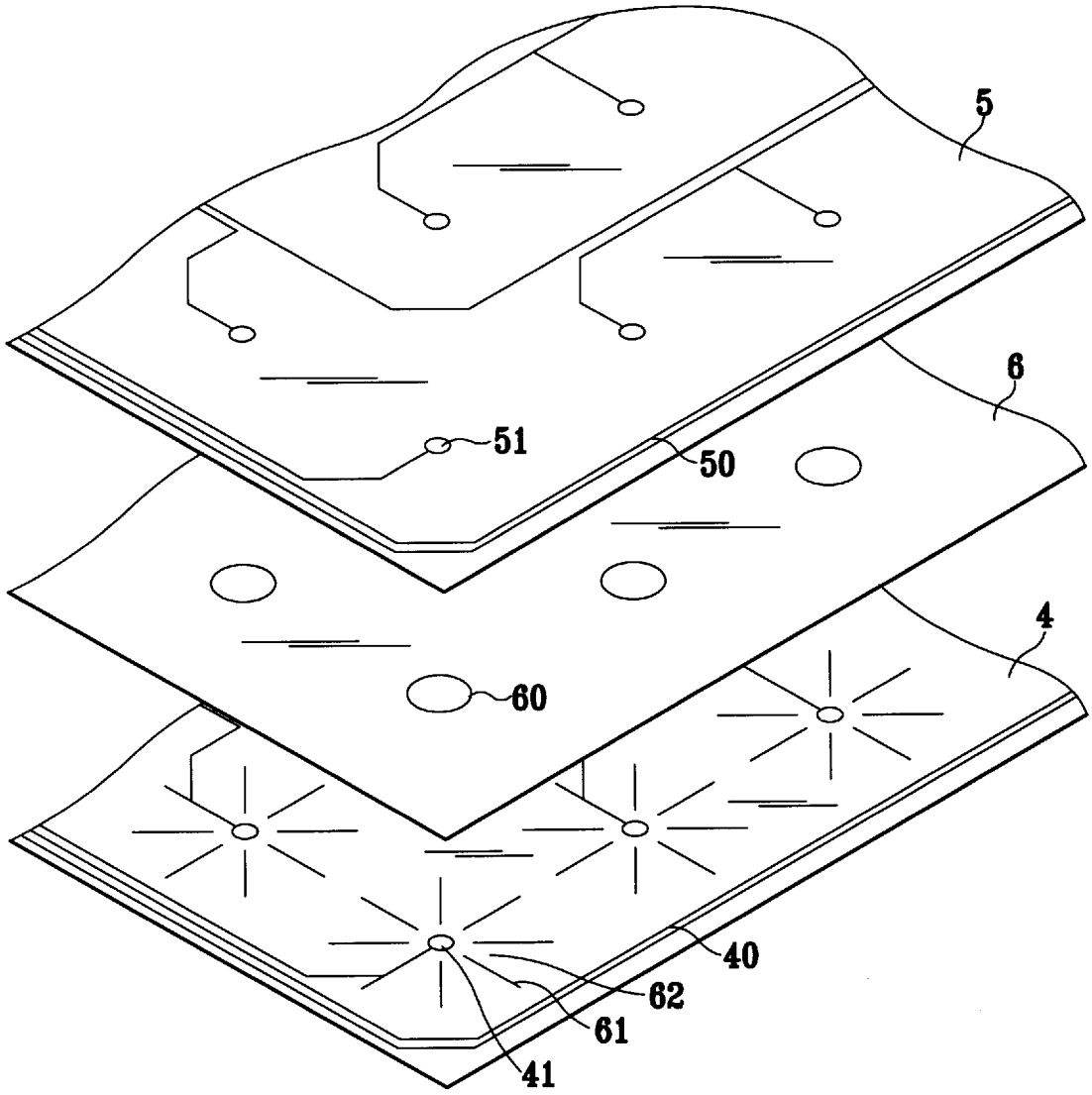
FIG. 3 is the partially perspective view of an preferred embodiment of the present invention.
Figure 4:
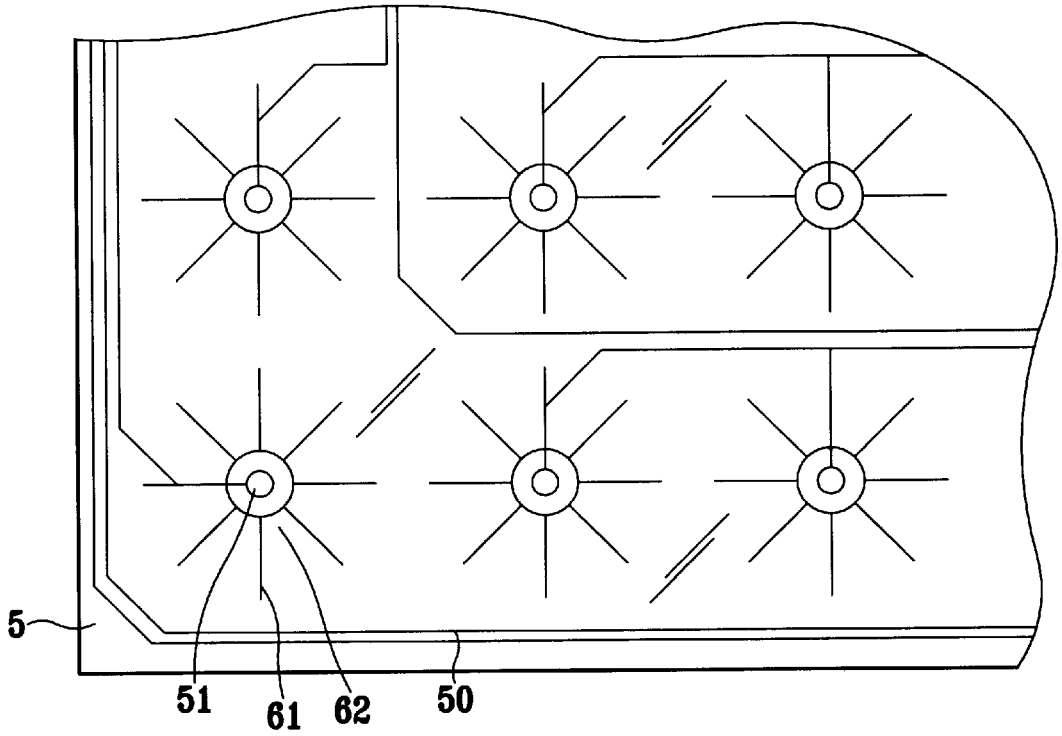
FIG. 4 is the partially top view of an preferred embodiment of the present invention.
Figure 5:
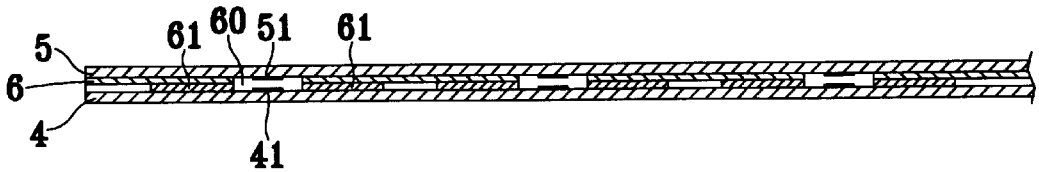
FIG. 5 is the partially side view of an preferred embodiment of the present invention.

With reference now to FIGS. 3 to 5, the layered structure according to an embodiment of the present invention comprises a lower flex circuit layer 4, an upper flex circuit layer 5 and a spacer layer 6. A circuit 40 and a plurality of contacts 41 are formed on the upper surface of the lower layer 4. The upper layer 5 is placed upon the lower layer 4 and has a circuit 50 and a plurality of contacts 51 corresponding to the contacts 41. The spacer 6 is sandwiched between the upper layer 5 and the lower layer 4, and has through holes 60 corresponding to the contacts 41 and 51.

Figure 6:
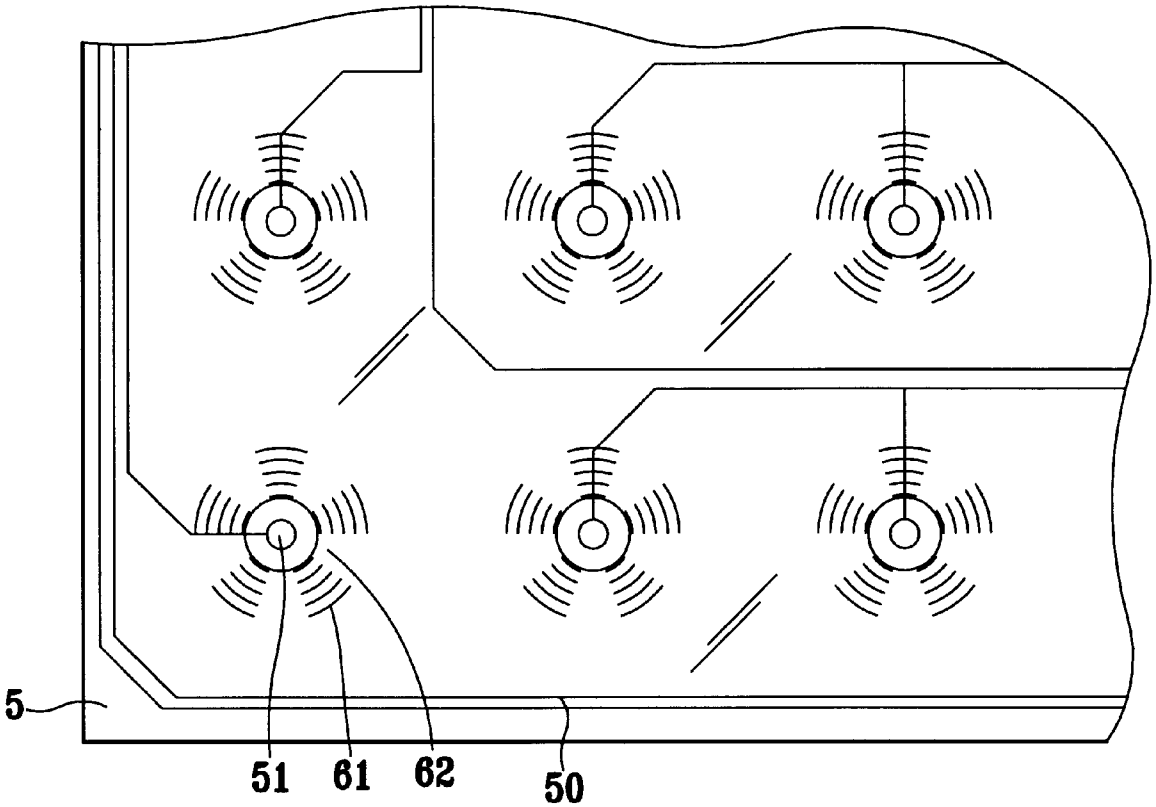
FIG. 6 is the partially top view of another preferred embodiment of the present invention.
Figure 7:
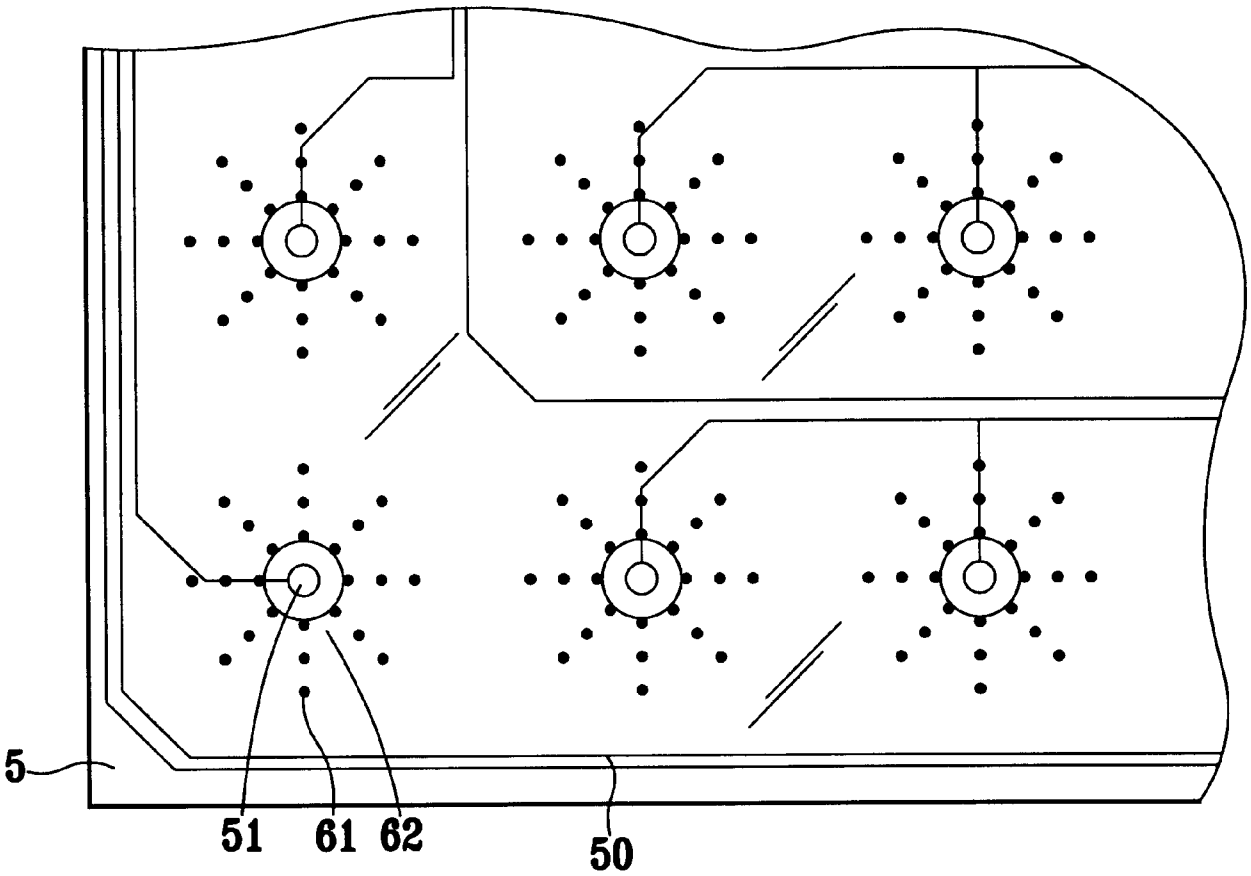
FIG. 7 is the partially side view of another preferred embodiment of the present invention.

To prevent the poor air leakage of the through hole 60 when the key is pressed or the vacuum sucking effect when the upper layer 5 is pressed to form a closed space, a plurality of projecting flanges 61 are formed on the upper or lower surface of the spacer layer 6 and outside the through hole 60, or on the lower surface of the upper layer 5, or on the upper surface of the lower layer 4. The flanges 61 are arranged radially and extends a specific radial length and a specific area, and an air passage 62 is formed between two adjacent flanges 61 and connected with the hole 60. As shown in FIGS. 3 and 4, the projecting flanges 61 can be of straight strap shape and extends radially. As shown in FIG. 6, the projecting flanges 61 can be of arc-shape and extends radially. As shown in FIG. 7, the projecting flange 61 can be of dot-shape and extends radially.

From above description, it is known that the projecting flange 61 can separate slightly the spacer layer 6 with the upper layer 5 and the lower layer 4, and provide a plurality of air passage 62 connected with the through hole 60. By the air passage 62, the through hole 60 will not be a closed space. The air in hole 50 can easily exit when the upper layer 5 is pressed down, the hole 60 can inhale air quickly through the air passage 62, thus prevents the vacuum sucking effect. The upper layer 5 can lift quickly to prevent the electric connection. Therefore, the key pressing efficiency is enhanced and the signal repeat problem can be overcome.

Moreover, the arrangement of the projecting flanges 61 is broader and more uniform such that the upper/lower layer can be prevented from attaching with the spacer layer 6 between adjacent two holes 60. The air passage 62 formed between two flanges 61 is arranged radially such that the air can be easily flew into or out of the holes 60. In this way, the keyswitch operation is more smooth and quickly.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A layered structure for a keyswitch comprising:

a lower flex circuit layer having a first electrical circuit and a plurality of first contacts formed on an upper surface thereof;

an upper flex circuit layer overlaying said lower flex circuit layer and having a second electrical circuit and a plurality of second contacts formed on a lower surface thereof in respective correspondence with said plurality of first contacts of said lower flex circuit layer;

a spacer layer disposed between said lower flex circuit layer and said upper flex circuit layer, said spacer layer having a plurality of through holes formed therein and located in correspondence with said plurality of first and second contacts,; and, a multiplicity of projecting flanges disposed between said lower flex circuit layer and said spacer layer, each of said through holes of said spacer layer having a respective plurality of said multiplicity of projecting flanges being angularly spaced around said through hole and radially extending therefrom to define a plurality of contiguous air passages surrounding said through hole, each said air passage extending between a respective pair of said angularly spaced projecting flanges and in open communication with said through hole.

2. The layered structure for a keyswitch as recited in claim 1 where said multiplicity of projecting flanges are formed on said upper surface said lower flex circuit layer.

3. The layered structure for a keyswitch as recited in claim 2 where each of said multiplicity of projecting flanges is formed by a strap-shaped member.

4. The layered structure for a keyswitch as recited in claim 2 where each of said multiplicity of projecting flanges is formed by a plurality of radially spaced arcuate members.

5. The layered structure for a keyswitch as recited in claim 2 where each of said multiplicity of projecting flanges is formed by a plurality of radially spaced dot-shaped members.

6. The layered structure for a keyswitch as recited in claim 1 where said multiplicity of projecting flanges are formed on a lower surface of said spacer layer.

7. The layered structure for a keyswitch as recited in claim 6 where each of said multiplicity of projecting flanges is formed by a strap-shaped member.

8. The layered structure for a keyswitch as recited in claim 6 where each of said multiplicity of projecting flanges is formed by a plurality of radially spaced arcuate members.

9. The layered structure for a keyswitch as recited in claim 6 where each of said multiplicity of projecting flanges is formed by a plurality of radially spaced dot-shaped members.

10. A layered structure for a keyswitch comprising:

a lower flex circuit layer having a first electrical circuit and a plurality of first contacts formed on an upper surface thereof;

an upper flex circuit layer overlaying said lower flex circuit layer and having a second electrical circuit and a plurality of second contacts formed on a lower surface thereof in respective correspondence with said plurality of first contacts of said lower flex circuit layer;

a spacer layer disposed between said lower flex circuit layer and said upper flex circuit layer, said spacer layer having a plurality of through holes formed therein and located in correspondence with said plurality of first and second contacts,; and, a multiplicity of projecting flanges disposed between said upper flex circuit layer and said spacer layer, each of said through holes of said spacer layer having a respective plurality of said multiplicity of projecting flanges being angularly spaced around said through hole and radially extending therefrom to define a plurality of contiguous air passages surrounding said through hole, each said air passage extending between a respective pair of said angularly spaced projecting flanges and in open communication with said through hole.

11. The layered structure for a keyswitch as recited in claim 10 where said multiplicity of projecting flanges are formed on said lower surface said upper flex circuit layer.

12. The layered structure for a keyswitch as recited in claim 11 where each of said multiplicity of projecting flanges is formed by a strap-shaped member.

13. The layered structure for a keyswitch as recited in claim 11 where each of said multiplicity of projecting flanges is formed by a plurality of radially spaced arcuate members.

14. The layered structure for a keyswitch as recited in claim 11 where each of said multiplicity of projecting flanges is formed by a plurality of radially spaced dot-shaped members.

15. The layered structure for a keyswitch as recited in claim 10 where said multiplicity of projecting flanges are formed on an upper surface of said spacer layer.

16. The layered structure for a keyswitch as recited in claim 15 where each of said multiplicity of projecting flanges is formed by a strap-shaped member.

17. The layered structure for a keyswitch as recited in claim 15 where each of said multiplicity of projecting flanges is formed by a plurality of radially spaced arcuate members.

18. The layered structure for a keyswitch as recited in claim 15 where each of said multiplicity of projecting flanges is formed by a plurality of radially spaced dot-shaped members.

* * * * *